United States Patent [19]

Ziegler

[11] 4,321,811

[45] Mar. 30, 1982

[54] LOCKING MECHANISM

[75] Inventor: Kurt Ziegler, Miami, Fla.

[73] Assignees: Ursula E. Ziegler; Ingrid Merritt; Donald E. Burg, all of Miami; Robert J. Van Der Wall, Coconut Grove, all of Fla.; a part interest

[21] Appl. No.: 231,748

[22] Filed: Feb. 5, 1981

[51] Int. Cl.[3] ..... E05B 17/14; E05B 19/06; E05B 27/04

[52] U.S. Cl. ..... 70/356; 70/358; 70/362; 70/364 A; 70/409; 70/423

[58] Field of Search ..... 70/356, 357, 362, 364 A, 70/376, 409, 419, 423, 424, 358, 427, 428

[56] References Cited

U.S. PATENT DOCUMENTS

| | | | |
|---|---|---|---|
| 1,477,318 | 12/1923 | Crass | 70/409 |
| 1,766,784 | 6/1930 | Gregory | 70/409 |
| 3,802,230 | 4/1974 | Tickett | 70/409 |
| 3,824,818 | 7/1974 | Neale | 70/358 |
| 4,161,871 | 7/1979 | Ziegler | 70/364 A |

FOREIGN PATENT DOCUMENTS

| | | | |
|---|---|---|---|
| 595834 | 4/1934 | Fed. Rep. of Germany | 70/409 |
| 2343878 | 10/1977 | France | 70/419 |

*Primary Examiner*—Robert L. Wolfe
*Attorney, Agent, or Firm*—Robert J. Van Der Wall

[57] ABSTRACT

An improved locking mechanism is provided with a fixed outer cylinder and at least two side-by-side rows of resiliently urged pins disposed in a staggered relation therein. A face plate contains a nonrotatable key slot in angular disorientation to the pins and a key is provided with a plurality of biased grooves forming inclined planes to depress the pins as the key, imposed in an inner cylinder, are rotated together through the plane of the pins. The inner cylinder is connected to a bolt actuating linkage in a conventional manner. A pin bar having a plurality of reversely biased grooves forming inclined planes in the same profile as the key is disposed in a longitudinally extending channel in the inner cylinder. The face plate is formed of an anti-drill metal secured to an intermediate housing by crimping in a peripheral area which is inaccessible between the intermediate and an outer housing. At least two rows of staggered pins in the outer cylinder permits the use of five movable pins with one fixed pin, permitting a greater number of combinations.

9 Claims, 9 Drawing Figures

LOCKING MECHANISM

FIELD OF THE INVENTION

The present invention pertains to the field of locks and particularly to locking mechanisms containing a plurality of resiliently urged pins which are retractable in a manner to permit the rotation of an inner cylinder, by a key having a plurality of transverse biased grooves with varying depths, relative to the axis of rotation of the inner cylinder.

BACKGROUND OF THE INVENTION

The present invention provides an improvement on the lock invention disclosed in my issued patent, U.S. Pat. No. 4,161,871 of July 24, 1979, and entitled, Locking Mechanism.

The present invention provides at least two rows of spring loaded pins disposed in a staggered side-by-side relationship in the outer cylinder, in combination with a pin bar provided, in the inner cylinder, with biased grooves therein, corresponding with biased grooves in the operating key, but in a reverse orientation therewith.

An outer anti-drill face plate protects the inner and outer cylinder, and the multiple rows of pins in the outer cylinder structure prevents the use of a blank key covered with wax or a like material to make an impression for the purpose of making a duplicate key. The first row of pins is contacted by the wax covered key and blocks the engagement thereof with the second or later rows of pins.

A double row of pins further provides for a minimum of six pins, three in each row, providing one fixed pin and five movable pins, one more than provided inconventional locks, resulting in a greater number of combinations.

SUMMARY OF THE INVENTION

Therefore, it is a principal object of the present invention to provide a locking mechanism for use within locks having an inner cylinder which is key rotatable within an outer cylinder, which includes at least two rows of staggered side-by-side resiliently urged pins in the outer cylinder for operable engagement by the key.

Another principal object of the invention is to adapt the use of multiple rows of pins for use with the pin bar, disclosed in the aforementioned issued patent.

A further object of the invention is to include at least one fixed pin in the multiple rows of pins.

Yet another object of the invention is to provide means to effectively shield resiliently urged pins in a lock from unauthorized external access.

An additional object of the invention is to provide an anti-drill face plate in a covering relation to the operating mechanism of the lock.

Another object is to provide a lock which has angular disorientation from the planes of the resiliently urged pins to inhibit unauthorized external access.

Other objects and advantages will become more fully apparent to those skilled in the art upon reading the following description of the drawings when read in reference thereto.

In accordance with the invention there is provided an improved locking mechanism comprising a fixed outer cylinder having a plurality of side-by-side rows of resiliently urged pins contained within a pin box attached to the outer cylinder and with the pins in staggered relation to each other. A face plate includes a key slot, is formed from an anti-drill metal, and is fixedly attached to the outer cylinder.

Rotatably disposed concentrically within the outer cylinder and behind the face plate is an inner cylinder having a key slot normally in alignment with the fixed key slot in the face plate. The key slots are sized to accept a key having traversely biased grooves forming inclined planes of variable height, the height of each being complimentary to a corresponding resiliently urged pin located in the pin box of the outer cylinder. The biased grooves are provided to depress the pins as the key and inner cylinder are rotated together past the pins.

A pin bar having reversely biased grooves in the same profile as the key is disposed within a longitudinal channel located in the inner cylinder. Said pin bar allows the inner cylinder to rotate backward past the pins, depressing same as the key does in the other rotational direction. The staggered relation of the pins allows the use of three pins in each of two rows within the same longitudinal distance as is possible with a single row of pins as in conventional locks.

The invention will be better understood after reference to the detailed description and drawings in which.

DETAILED DESCRIPTION

Figure 1:
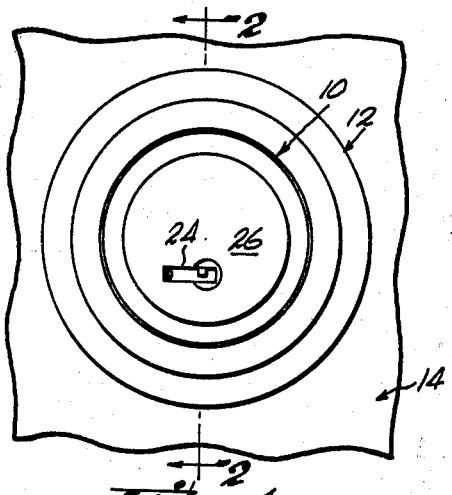
FIG. 1 is a front elevational view of the invention, illustrating the horizontal key slot in the fact plate thereof.
Figure 2:
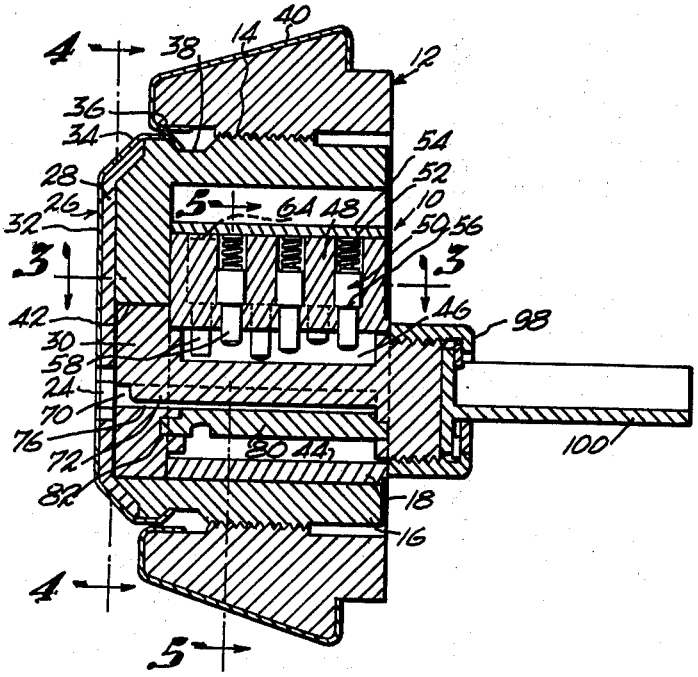
FIG. 2 is an enlarged vertical cross sectional taken along line 2—2 of FIG. 1.
Figure 3:
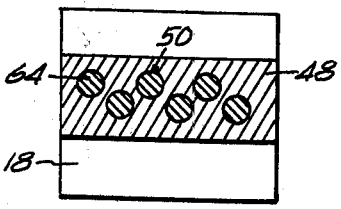
FIG. 3 is a horizontal sectional view taken along line 3—3 of FIG. 2.

With reference to the drawings and particularly to FIGS. 1 and 2, a fixed lock assembly 10 is illustrated centrally of an outer housing 12 mounted to an object 14, FIG. 1, such as a door, to be locked. The mounting means are not illustrated and generally consist of conventional projections from the housing which extend through the door with an inner cover plate and screw means disposed therethrough for engagement in the projections.

Figure 8:
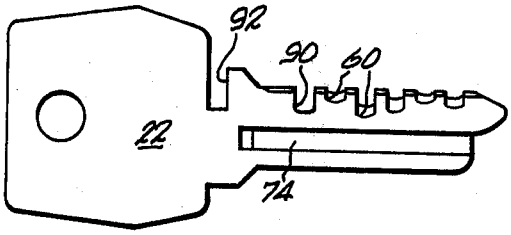
FIG. 8 is an elevational side view of the key of the present invention.
Figure 9:
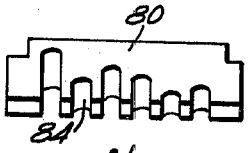
FIG. 9 is a top plan view of the pin bar, illustrating the biased grooves therein, which are reversely biased relative to the key grooves.

With further reference to FIG. 2, the fixed central lock assembly 10 is illustrated in a screwthreaded attachment at 14 to the outer housing 12 and includes an intermediate housing 16 defining an interior cavity for reception of an inner housing, comprising the outer cylinder 18 of the lock assembly of the present invention. A key 22, as best seen in FIG. 8, is provided for reception through a horizontally disposed key slot 24, FIGS. 1 and 2, in a face place assembly 26.

With particular reference to the face plate assembly 26, an anti-drill plate 28, formed of a suitable hardened metal is formed to cover the outside surfaces of the intermediate housing 16 and an inner rotatable lock cylinder 30, rotatably mounted in outer cylinder 18. A cover plate 32 is disposed over the anti-drill plate 28, including a peripheral portion 34, bent around the periphery of the intermediate housing 16 and crimped at 36 into a peripheral angular groove 38 therein. Cover plate 32 may be of a decorative nature to match a similar cover 40, crimped around outer housing 12.

The inner lock cylinder 30 is rotatably mounted through bores 42 in intermediate housing 16, and 44 in outer cylinder 18 and is cross sectionally configurated to define a cavity 46 within outer cylinder 18. A pin box 48 is formed integral with outer cylinder 18 and includes at least two rows of staggered pins 50 slidably engaged therein and resiliently urged inwardly as by springs 52 engaged against a fixed outer cap 54 on the pin box 48.

Each pin includes a shoulder stop 56 and a reduced diameter portion 58 projecting a predetermined distance into cavity 46. The reduced diameter portions are of varying random preselected lengths which determine the depths of the complimentary transverse biased grooves 60 in key 22. Preferable at least one pin, such as 64, is rigidly fixed in place, that is, it is not resiliently movable as by a spring. Such fixed pin is used to further inhibit unauthorized external access to the pins and is preferably located in the first position nearest the face place, and is matched to a groove in the key and in the pin bar which is straight cut without a transverse bias therein since the fixed pin cannot be depressed by rotation of the key.

A key slot 70 is longitudinally formed in the inner cylinder 30, in alignment with the face place slot 24, and a longitudinally extending spline 72 is defined therein for sliding reception in a longitudinal key groove 74, when the key 22 is inserted in slot 70. Spline 72 is of a substantial thickness to provide a minimal slot thickness at 76, FIG. 2.

A pin bar 80 is slidably inserted into opposed end channels 82, FIG. 2, of the inner cylinder 30 before assembly thereof in outer cllinder 18, and includes a plurality of reversely biased grooves 84, in the same profile relative to biased grooves 60, defined in key 22, there being one biased groove 60 and reversely biased groove 84 for each reduced diameter pin portion 58.

All of the key grooves 60 are biased to form inclinded planes with the exception of groove 90 which accommodated the fixed pin 58 as noted above. Key groove 92, as seen in FIG. 8, permits the key to rotate within face place assembly 26.

Figure 4:
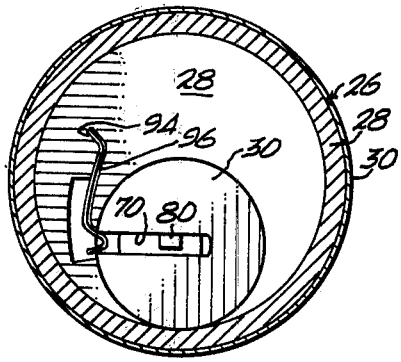
FIG. 4 is a vertical sectional view taken along line 4—4 of FIG. 2.

FIG. 4 illustrates a spring detent 94 inset at 96 in the intermediate housing 16 to cooperate with the key 92 to securely position and maintain the key slot 92 in a key reception attitude in both the locked and unlocked positions.

The inner cylinder 30 is secured at 98 to a conventional bolt actuating mechanism 100 for operation thereof in a conventional manner.

Figure 5:
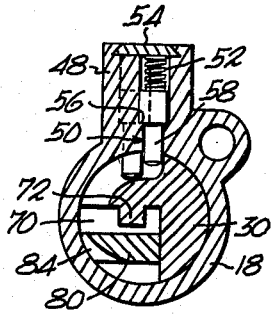
FIGS. 5, 6, and 7 are vertical sectional views taken along line 5—5 of FIG. 2, illustrating the sequential operation of the lock.

FIG. 5 illustrates the lock of the present invention without the key engaged therein, and with the key slot 70 in a laterial key inserting position, all of the pins 50 being in fully extended positions to block rotational movement of the inner cylinder 30, from a locked to an unlocked position.

Figure 6:
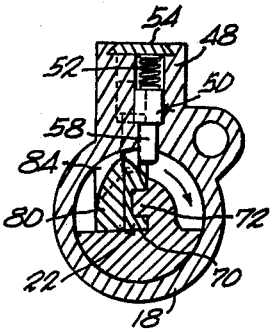

FIG. 6, illustrates the unlocking operation in which both rows of pins 50 are lifted in response to a properly formed key 22 passing thereunder during clockwise rotation thereof in the key slot 70.

Figure 7:
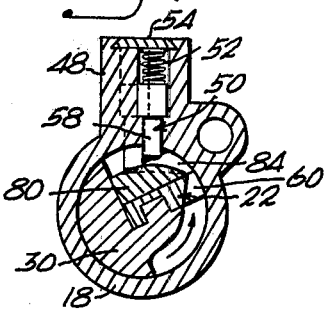

FIG. 7 illustrates the locking operation in which both rows of pins 50 are lifted in response to a properly formed pin bar 80 passing thereunder as the inner cylinder 30 is rotated counterclockwisely by means of the key 22.

Having described a preferred form of the improved locking mechanism of the present invention it should be understood that various changes can be made therein without departing from the true spirit of the invention. Accordingly, there are covered all alternatives, modifications and equivalents as may be included within the spirit and scope of the invention as defined solely by the appended claims.

What is claimed is:

1. A locking mechanism for use with locks having an outer cylinder with a pin box and bolt actuating linkage, comprising:

a housing means for fixed attachment to an object to be locked, and including a face plate fixed to the housing with a fixed slot through, the face plate in angular disorientation to the pin box;

an inner cylinder rotatably mounted in a concentric relationship within the outer cylinder including a key slot therein and having a pin bar substantially adjacent and parallel to a plane of the key slot, said pin bar having a plurality of reversely biased transverse grooves forming inclined planes of random height;

a plurality of side-by-side rows of movable resiliently urged pins of predetermined lengths in the same profile as the random height of the grooves of the pin bar and disposed in staggered relation to each other in the pin box, including means to retain the pins therein; and a means connecting the inner cylinder to the bolt actuating linkage.

2. The locking mechanism of claim 1 wherein each row of the pins is comprised of a predetermined plurality of pins with at least one of the rows including at least one fixed pin having no resilient urging means.

3. The locking mechanism as defined in claim 1 wherein the face plate is formed of a suitable anti-drill material.

4. The locking mechanism as defined in claim 1, wherein the pin bar is removably retained in the inner cylinder.

5. The locking mechanism as defined in claim 2 including a key having a head and an elongated shank portion provided with one transversely biased groove to accommodate each of the resiliently urged, random length pins and an unbiased groove for the fixed pin operation.

6. The locking mechanism of claim 5 wherein the bias of the grooves in the key is reverse the bias of the grooves in the pin bar.

7. The locking mechanism as defined in claim 1 including a longitudinally extending spline within the key slot for engagement in a companion groove, defined in a key for use in the locking mechanism.

8. The locking mechanism as defined in claim 1 including spring detent means, mounted in the housing means, to engage in a portion of the key slot in a locked position.

9. The locking mechanism as defined in claim 1 including shoulder means on the inner cylinder to restrict rotational movement thereof, relative to said pins, between limits of rotation in both directions.

* * * * *